US005561908A

United States Patent [19]

Leini

[11] Patent Number: 5,561,908

[45] Date of Patent: Oct. 8, 1996

[54] CHAINSAW GUIDE BAR

[75] Inventor: Arvo Leini, Edsbyn, Sweden

[73] Assignee: Sandvik AB, Sandviken, Sweden

[21] Appl. No.: 239,316

[22] Filed: May 6, 1994

Related U.S. Application Data

[63] Continuation of PCT/SE92/00766, Nov. 5, 1992 published as WO93/08968, May 13, 1993.

[30] Foreign Application Priority Data

Nov. 6, 1991 [SE] Sweden ..... 9103267

[51] Int. Cl.[6] ..... B27B 17/02

[52] U.S. Cl. ..... 30/383; 30/381

[58] Field of Search ..... 30/383, 381, 384, 30/385, 386, 387

[56] References Cited

U.S. PATENT DOCUMENTS

| | | | |
|---|---|---|---|
| 1,397,026 | 11/1921 | Wolf . | |
| 1,526,451 | 2/1925 | Wolf . | |
| 2,774,395 | 12/1956 | Tweedle . | |
| 2,897,856 | 8/1959 | Carlton . | |
| 2,948,309 | 8/1960 | Hoff et al. . | |
| 2,962,812 | 12/1960 | Gommel . | |
| 3,102,562 | 9/1963 | Horncastle . | |
| 3,119,418 | 1/1964 | Rayniak et al. . | |
| 3,185,191 | 5/1965 | Olsen . | |
| 3,241,228 | 3/1966 | Rayniak et al. . | |
| 3,377,214 | 4/1968 | Woodbridge et al. . | |
| 3,416,578 | 12/1968 | Irgens . | |
| 3,473,581 | 10/1969 | Merz . | |
| 3,542,094 | 11/1970 | Gibson et al. . | |
| 3,726,326 | 4/1973 | Coleman . | |
| 3,744,363 | 7/1973 | Espana et al. . | |
| 3,760,141 | 9/1973 | Espana et al. . | |
| 3,858,321 | 1/1975 | Conaty | 30/383 |
| 3,987,543 | 10/1976 | Rätz et al. . | |
| 3,991,799 | 11/1976 | Albright . | |
| 4,138,813 | 2/1979 | Harada et al. . | |
| 4,415,378 | 11/1983 | McKinney et al. . | |
| 4,641,432 | 2/1987 | Kume . | |
| 4,693,007 | 9/1987 | Apfel et al. . | |
| 4,722,141 | 2/1988 | Lim et al. . | |
| 4,768,289 | 9/1988 | Apfel et al. . | |
| 4,874,437 | 10/1989 | Masuda et al. . | |
| 4,958,670 | 9/1990 | Johnson . | |
| 4,965,934 | 10/1990 | Eriksson et al. . | |
| 5,052,109 | 10/1991 | Vanderzanden et al. . | |
| 5,093,998 | 3/1992 | Seigneur et al. | 30/383 X |
| 5,144,867 | 9/1992 | Yajima et al. . | |

FOREIGN PATENT DOCUMENTS

| | | |
|---|---|---|
| 9308968 | 5/1993 | WIPO . |

*Primary Examiner*—Rinaldi I. Rada
*Assistant Examiner*—Elizabeth Stanley
*Attorney, Agent, or Firm*—Burns, Doane, Swecker & Mathis, L.L.P.

[57] ABSTRACT

Guide bar for chain saws, where the chain is supposed by a nose sprocket while traversing the front end. Regions of the edges of the guide bar are locally hardened to a higher hardness than the rest of the guide bar. The regions of hardness are only where the chair impacts the bar near an attachment end of the guide bar after having left the drive sprocket of the power socket, and where the chain settles on the guide bar edge after having been supported by the nose sprocket while traversing the nose curvature.

18 Claims, 1 Drawing Sheet

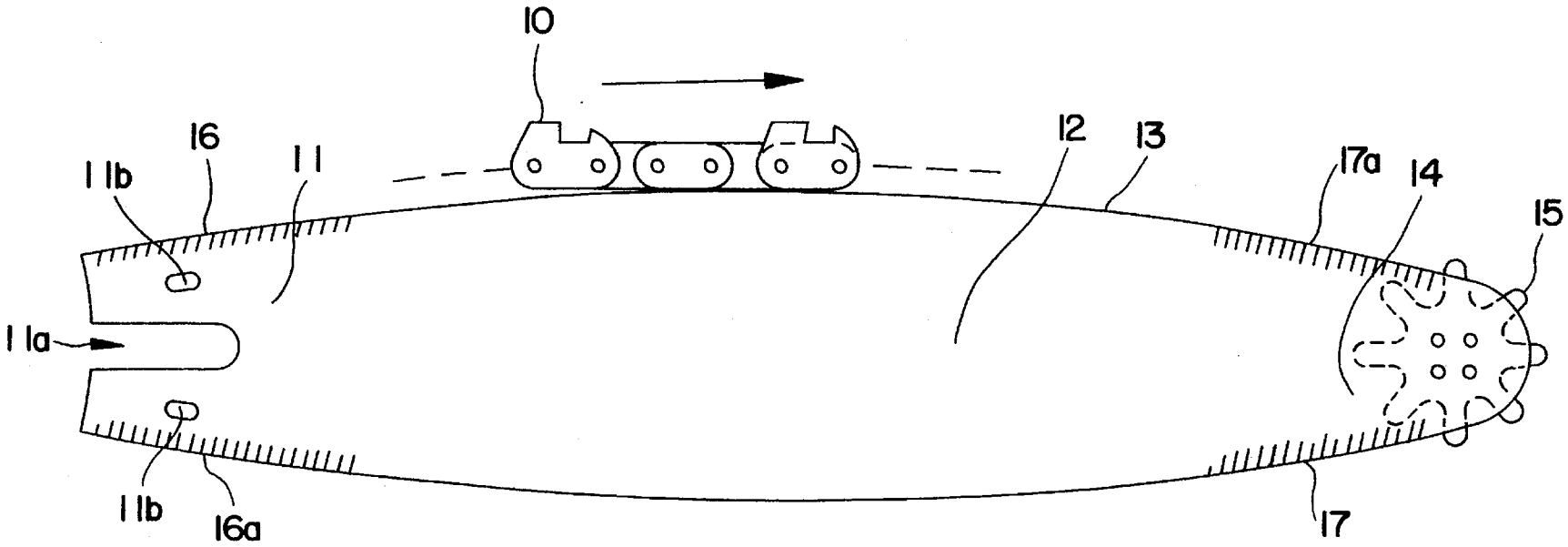
15
14
17a
17
13
12
10
11
16
16a
11b
11b
11a

CHAINSAW GUIDE BAR

RELATED APPLICATIONS

This application is a continuing application of PCT/SE92/00766, filed Nov. 5, 1992, which designated the U.S., and of Swedish Application No. 9103267-2, filed Nov. 6, 1991.

BACKGROUND AND SUMMARY OF THE PRESENT INVENTION

Chainsaws are traditionally made with guide bars, where the saw chain runs with the drivelink tangs in a groove along the perimeter of the guide bar and is carried at the front end of the guide bar by a toothed sprocket inserted in the guide bar. The guide bars are either solid, i.e., made from a single steel plate with a milled or ground groove, or laminated, i.e., made from three thinner plates joined by spot welding, with the groove being created by making the middle plate smaller than the side plates. The guide bars are usually hardened along the edges to improve the wear resistance where the chain slides along the guide bar, and unhardened or only slightly hardened between the edges.

It has been shown, however, that guide bars of the known types when used in vehicle-born tree harvester machines are easily damaged if the grip of the machine around the tree trunk is not firm enough. A common type of damage is whew the guide bar is bent near the end attached to the machine. It is often difficult or impossible to straighten such a guide bar, because of cracks in the hardened edge and fractures near the spot welds, where hard brittle regions border on soft heat affected zones.

U.S. Pat. No. 5,052,109 discloses that soft annealing of a zone across the width of the guide bar near the end attached to the machine will concentrate any bending to this zone, where the hardness both at the weld spots and at the previously hardened edges is low enough to avoid fracture, and that such a guide bar is easy to straighten after it has been bent. Disadvantages with this method are that the force a guide bar can withstand without bending is lower, and that the edges may become wrinkled during the concentrated bending and difficult to get smooth when the rest of the bar is straightened.

U.S. Pat. No. 4,965,934 discloses how the weld spots of a laminated guide bar can be made ductile without annealing or with a low temperature annealing that does not diminish the hardness imparted to the side plates during previous hardening. Disadvantages with this method are that some risk of cracks at the edges remains and that the lower middle plate hardness lowers the stiffness of the bar.

The present invention concerns a guide bar where the risk of cracks at the edges is eliminated without lowering of the bending resistance, and where any bending will not be so concentrated that the edges could get wrinkled.

BRIEF DESCRIPTION OF THE DRAWING

The present invention will be described with reference to the single drawing figure which shows a side view of a guide bar.

DETAILED DESCRIPTION OF THE PREFERRED EMBODIMENT

The guide bar includes an attachment end (11) with a hole for fastening bolts (11*a*) and holes for providing oil supply (11*b*), the bar includes one central part (12) with very slightly curved edges (13), one front end (14) and one toothed sprocket (15) inserted with its bearing into the front end. With vehicle born tree harvesters the lubrication of the saw chain (10) is usually so well controlled through internal oil channels in the guide bar that there is no appreciable wear on the slightly curved edges (13) of the central part (12), which in consequence does not need as high hardness as is traditionally specified.

The wear on the edges is concentrated in those regions where the saw chain (10) impacts the edges after traveling a shorter or longer path without support from the edges. In these regions, high peak forces occur and lubrication cannot easily be arranged there. Such regions are where the chain part coming from the drive sprocket first impacts the guide bar edge (16) at the attachment end (11), and where the saw chain, after having traversed the front end (14) while elevated and supported by the sprocket (15), settles again on the edge (17) at the front end. Within these limited regions (16,17) the edge should be considerably harder than the slightly curved edges (13) of the central part (12) in order to limit the wear. The hardening of the edge regions extends, only a small predetermined extent from the edge of the guide bar to ensure that the central part (12) is not hardened, preferably less than 20% of the width of the guide bar. To make the guide bar reversible, the edge should preferably be made with the higher hardness also in the symmetrically located regions (16*a*, 17*a*).

At the front end (14), the bending moment is small since any forces are at a short distance, and at the attachment end (11) no bending is possible since it is clamped between rigid blocks. Thus the edge in the regions (16, 17) can be harder and more wear resistant than the rest of the edge without the risk of edge cracking.

When no cracks are initiated at the edge, the rest of the guide bar can be made harder than usual, lowering the risk of concentrated bending and edge wrinkling considerably. Suitable hardness values for the regions with highest hardness (16,17) are 60–64 and for the rest of the guide bar 48–53 according to the Rockwell C scale. Traditional hardness values for guide bars, where the whole length of the edges are hardened, is 59–61 for the edges and 42–47 for other parts of the guide bar.

Before regional edge hardening, the entire guide bar is preferably hardened and tempered to the hardness 48–53 HRC. For laminated bars this is done after spot welding, thus eliminating any heat affected zones near the weld spots. Alternatively, the guide bar can be made from two pre-hardened side plates and a boron alloy middle plate as disclosed in U.S. Pat. No. 4,965,934.

The edge hardening of the hard regions (16,17) can be done with a gas flame or with inductive heating in known ways. According to the invention, the length of each hardened region (16, 17) should not exceed one third of the length of the entire guide bar.

The principles, preferred embodiment, and mode of operation of the present invention has been described in the foregoing specification. However, the invention is not intended to be limited to the disclosed embodiment but encompasses variations and changes that fall within the appended claims.

What is claimed is:

1. Guide bar for saw chain, comprising a groove along edges of the guide bar, the edges of the guide bar including longitudinal edges, for guiding drive links of a saw chain, a nose sprocket for supporting the saw chain while it traverses a front end of the guide bar, the nose sprocket being inserted in the guide bar in a nose sprocket region of the guide bar, the longitudinal edges of the guide bar having regions locally hardened by heat treatment to a higher hardness than a remaining portion of the guide bar, at least one of the locally hardened regions extending into the nose sprocket region for a limited distance and at least one other locally hardened region extending, for a limited distance, toward an attachment end of the guide bar, opposite the nose sprocket region, where the guide bar is attached to a saw chain drive, a central region of the longitudinal edges of the guide bar between the locally hardened regions and a front end curvature of the guide bar remaining at lower hardness than the locally hardened regions.

2. Guide bar according to claim 1, wherein the locally hardened regions extend for a length less than one third of the length of the guide bar.

3. Guide bar according to claim 1, wherein the locally hardened regions are symmetrically located relative to the longitudinal axis of the guide bar.

4. Guide bar according to claim 1, wherein the locally hardened regions have a hardness of 60–64 Rockwell C.

5. Guide bar according to claim 1, wherein the locally hardened regions extend inwardly a predetermined distance from the longitudinal edges.

6. Guide bar according to claim 1, wherein the entire guide bar is hardened and the locally hardened regions are subsequently further hardened.

7. Guide bar according to claim 1, wherein a guide bar body region between the longitudinal edges being of a uniform hardness.

8. Guide bar according to claim 7, wherein the hardness of the guide bar body region is in a range of 48–53 Rockwell C.

9. Guide bar according to claim 1, wherein the guide bar is a laminated guide bar.

10. Guide bar according to claim 1, wherein the guide bar is a solid guide bar.

11. Guide bar according to claim 1, including one or more components having one or more spot welds therein, the guide bar being uniformly hardened and tempered after spot welding so that heat affected zones near spot welds are eliminated, and thereafter locally hardened to provide the locally hardened regions.

12. Guide bar as set forth in claim 1, wherein the locally hardened regions include two regions, each region including local hardening symmetrically disposed on opposing sides of the guide bar.

13. Guide bar as set forth in claim 1, wherein the locally hardened regions all individually extend in a lengthwise direction of the guide bar less than one third of a total length of the guide bar.

14. Guide bar as set forth in claim 1, wherein local hardening of the locally hardened regions extends inwardly in a widthwise direction of the guide bar less than 20% of a total width of the guide bar.

15. Guide bar according to claim 1, wherein the central region of the longitudinal edges is curved outwardly.

16. Guide bar for saw chain, comprising a groove along edges of the guide bar, the edges of the guide bar including longitudinal edges, for guiding drive links of a saw chain, a nose region around which the saw chain travels as it traverses a from end of the guide bar, the longitudinal edges of the guide bar having regions locally hardened by heat treatment to a higher hardness than a remaining portion of the guide bar, at least one of the locally hardened regions extending into the nose region for a limited distance and at least one other locally hardened region extending, for a limited distance, toward an end of the guide bar, opposite the nose region, where the guide bar is attached to a saw chain drive, a central region of the longitudinal edges of the guide bar between the locally hardened regions and a front end curvature of the guide bar remaining at lower hardness than the locally hardened regions, the guide bar including one or more components having one or more spot welds therein, the guide bar being uniformly hardened and tempered after spot welding so that heat affected zones near spot welds are eliminated, and thereafter locally hardened to provide the locally hardened regions.

17. Guide bar according to claim 16, wherein a guide bar body region between the longitudinal edges being of a uniform hardness.

18. Guide bar according to claim 17, wherein the hardness of the guide bar body region is in a range of 48–53 Rockwell C.

* * * * *